US009156532B2

(12) United States Patent
Shiue

(10) Patent No.: US 9,156,532 B2
(45) Date of Patent: Oct. 13, 2015

(54) WATERPROOF MASK

(75) Inventor: Chih-Cheng Shiue, Taipei (TW)

(73) Assignee: QBAS CO., LTD., Taipei (TW)

( * ) Notice: Subject to any disclaimer, the term of this patent is extended or adjusted under 35 U.S.C. 154(b) by 431 days.

(21) Appl. No.: 13/210,433

(22) Filed: Aug. 16, 2011

(65) Prior Publication Data

US 2012/0047615 A1 Mar. 1, 2012

(30) Foreign Application Priority Data

Aug. 26, 2010 (TW) ..... 99128656 A
Dec. 16, 2010 (TW) ..... 99144341 A

(51) Int. Cl.
*B63C 11/12* (2006.01)
*A63B 33/00* (2006.01)

(52) U.S. Cl.
CPC ..... *B63C 11/12* (2013.01); *A63B 33/002* (2013.01); *A63B 2209/00* (2013.01)

(58) Field of Classification Search
CPC ..... A41D 13/11; A41D 13/1161; A41D 13/1176; A41D 13/1107; A41D 13/1115; A41D 13/1146; B63C 11/12; A61F 9/02; A63B 33/002; A63B 2209/00
USPC ..... 2/426, 428, 439, 431, 440, 442, 446, 2/448, 449, 450
See application file for complete search history.

(56) References Cited

U.S. PATENT DOCUMENTS 2,608,687 A * 9/1952 Ellis ..... 2/445
2,727,237 A * 12/1955 Malcom, Jr. ..... 2/445
2,877,462 A * 3/1959 Moeller ..... 2/440
4,087,865 A * 5/1978 Garofalo ..... 2/428
4,264,988 A * 5/1981 Specht ..... 2/431
4,689,837 A * 9/1987 Bolle ..... 2/440
5,802,622 A * 9/1998 Baharad et al. ..... 2/434
5,867,841 A * 2/1999 Chiang ..... 2/436
5,884,339 A 3/1999 Fukasawa
6,272,693 B1 * 8/2001 Godoy ..... 2/430
6,349,418 B1 * 2/2002 Chiang ..... 2/428
6,505,353 B2 * 1/2003 Sung ..... 2/428
6,513,170 B1 * 2/2003 Chiang ..... 2/428

(Continued)

FOREIGN PATENT DOCUMENTS

CN 2341676 Y 10/1999
CN 2574728 Y 9/2003

(Continued)

OTHER PUBLICATIONS

English translation of abstract of CN 200995036 (published Dec. 26, 2007).

(Continued)

*Primary Examiner* — Alissa L Hoey
(74) *Attorney, Agent, or Firm* — McClure, Qualey & Rodack, LLP

(57) ABSTRACT

A waterproof mask is provided in this invention. The waterproof mask comprises a frame portion and a leaning portion that is tightly connected to the frame portion. The leaning portion has a plurality of first structures and a plurality of second structures, which are alternately arranged. The first thickness of each of the first structures is thinner than the second thickness of the second structure. Due to the differences in thickness, the leaning portion of the waterproof mask can be adjusted according to the user's face shape for a perfect fit.

18 Claims, 9 Drawing Sheets

(56) References Cited

U.S. PATENT DOCUMENTS

| | | | | |
|---|---|---|---|---|
| 6,928,663 | B1 * | 8/2005 | Tappeiner | 2/436 |
| 6,966,068 | B2 * | 11/2005 | Johnson et al. | 2/68 |
| 7,181,778 | B1 * | 2/2007 | Garraffa et al. | 2/428 |
| 7,331,065 | B1 * | 2/2008 | Chen | 2/448 |
| 7,356,854 | B2 * | 4/2008 | Sheldon | 2/448 |
| 7,552,484 | B2 * | 6/2009 | Seynhaeve et al. | 2/440 |
| 7,779,488 | B2 * | 8/2010 | Fukasawa | 2/428 |
| 7,891,024 | B2 * | 2/2011 | Garofalo et al. | 2/426 |
| 2002/0178489 | A1 | 12/2002 | Sung | |
| 2003/0046751 | A1 * | 3/2003 | Chiang | 2/442 |
| 2003/0221246 | A1 * | 12/2003 | Schary et al. | 2/453 |
| 2004/0006813 | A1 * | 1/2004 | Chiang | 2/428 |
| 2004/0148684 | A1 * | 8/2004 | Wiedner | 2/428 |
| 2005/0210568 | A1 * | 9/2005 | Sheldon | 2/426 |
| 2006/0117469 | A1 * | 6/2006 | Garofalo et al. | 2/428 |
| 2006/0162055 | A1 * | 7/2006 | Kuroda | 2/428 |
| 2007/0130675 | A1 * | 6/2007 | Sheldon | 2/448 |
| 2007/0250994 | A1 * | 11/2007 | McNeal et al. | 2/426 |
| 2008/0010728 | A1 * | 1/2008 | Speed | 2/426 |
| 2008/0074607 | A1 * | 3/2008 | Godoy | 351/43 |
| 2008/0120767 | A1 * | 5/2008 | Garofalo | 2/428 |
| 2008/0196714 | A1 * | 8/2008 | Shiue | 128/201.27 |
| 2008/0257342 | A1 * | 10/2008 | Shiue | 128/201.28 |
| 2008/0301858 | A1 * | 12/2008 | Wang-Lee | 2/436 |
| 2009/0165191 | A1 * | 7/2009 | Kuroda | 2/428 |
| 2009/0217444 | A1 * | 9/2009 | Pan | 2/428 |
| 2013/0111655 | A1 * | 5/2013 | Kuroda | 2/431 |

FOREIGN PATENT DOCUMENTS

| | | | |
|---|---|---|---|
| CN | 200995036 | | 12/2007 |
| DE | 20116237 | | 12/2001 |
| EP | 1153630 | A1 | 11/2001 |
| JP | 51-7200 | U | 1/1976 |
| JP | 09-000130 | | 1/1997 |
| JP | 2002-078821 | | 3/2002 |
| JP | 2009-160123 | | 7/2009 |
| JP | 2010-057880 | | 3/2010 |

OTHER PUBLICATIONS

English translation of abstract of CN 2574728 (published Sep. 24, 2003).
China Office Action dated Feb. 22, 2013.
English translation by machine of China Office Action dated Feb. 22, 2013.
English translation of abstract of JP 51-7200 (published Jan. 19, 1976).
Taiwan Office Action dated Apr. 15, 2013.
English translation (by machine) of Taiwan Office Action dated Apr. 15, 2013.
English translation of abstract of JP 2009-160123 (published Jul. 23, 2009).
English translation of abstract of JP 2010-057880 (published Mar. 18, 2010).
Japan Office Action dated Nov. 13, 2012.
English translation by machine of Japan Office Action dated Nov. 13, 2012.
Japan Office Action dated Dec. 3, 2013.
English translation (by machine) of Japan Office Action dated Dec. 3, 2013.
English translation (by machine) of JP 09-000130 (published Jan. 7, 1997).
English translation (by machine) of JP 2002-078821 (published Mar. 19, 2002).

* cited by examiner

WATERPROOF MASK

This application claims the benefits from the priority to Taiwan Patent Applications No. 099128656 filed on Aug. 26, 2010 and 099144341 filed on Dec. 16, 2010, the disclosures of which are incorporated by reference herein in their entirety.

BACKGROUND OF THE INVENTION

1. Field of the Invention

The present invention provides a waterproof mask, of which the leaning portion has structures of different thicknesses that are alternately arranged.

2. Descriptions of the Related Art

Swimming, snorkeling and diving are all water sports that have gained great popularity. Because the profiles, comfort, durability, and prices of water sport equipment are important, innovative technologies related to the development of various waterproof masks have been developed in the art. The biggest challenge in the development of waterproof masks is to increase comfort but decrease price.

FIG. 1A illustrates a perspective view of a conventional waterproof mask for use in diving or snorkeling. A conventional waterproof mask 1 for use in diving or snorkeling comprises a frame portion 11 and a leaning portion 12. The frame portion 11 has two lenses 111, and is tightly connected to the leaning portion 12 to define a cavity (not shown). When the waterproof mask 1 is worn, the leaning portion 12 of the waterproof mask 1 is attached around the user's eyes and nose to prevent water from entering the cavity and causing discomfort.

However, there are many different face shapes, varying from elongated faces to flat faces and from wide faces to narrow faces. Therefore, it is extremely difficult to provide a "one-size fits all" waterproof mask. In addition, when purchasing, the user may not know which waterproof mask best fits his or her face shape without trying every mask on. As a result, manufacturers have had to develop waterproof masks that come in various sizes. Unfortunately, the development of multiple waterproof masks increase manufacturing costs and thereby, drives the costs of the products higher.

Similarly, FIG. 1B shows a conventional waterproof mask 1' for use in swimming with the same problem as the waterproof mask 1 shown in FIG. 1A. When the user wears the waterproof mask 1' while swimming, the leaning portion 12' cannot be fitted around the user's eyes exactly according to the user's face shape. This often causes water to flow into the cavity, causing comfort when the water gets into the user's eyes.

Accordingly, there is an urgent need in the art to provide a waterproof mask which can be worn by users' with different face shapes, while decreasing manufacturing costs.

SUMMARY OF THE INVENTION

To solve the aforesaid problems, an objective of the present invention is to provide a waterproof mask. By having structures of different thicknesses alternately arranged on the leaning portion of the waterproof mask, the leaning portion can be stretched to suit different face shapes for a tight fit around the user's eyes and nose. Therefore, the waterproof mask of the present invention is suitable for use with the face shapes of different users to reduce the additional cost associated with the development of waterproof masks of various sizes.

The present invention provides a waterproof mask, which comprises a frame portion and a leaning portion. The frame portion has at least one lens. The leaning portion is tightly connected to the frame portion and has a plurality of first and second structures which are alternately arranged. The first thickness of each of the first structures is thinner than the second thickness of each of the second structures. The leaning portion has at least one of a flat upper surface and a flat lower surface.

The detailed technology and preferred embodiments implemented for the subject invention are described in the following paragraphs accompanying the appended drawings for people skilled in this field to well appreciate the features of the claimed invention.

DESCRIPTION OF THE PREFERRED EMBODIMENT

In the following description, the present invention will be explained with reference to embodiments thereof. However, the description of these embodiments is only for the purpose of illustration rather than limitation. It should be appreciated that in the following embodiments and attached drawings, elements not directly related to the present invention are omitted from depiction; and the sizes of and dimensional relationships among individual elements in the attached drawings are illustrated only for the ease of understanding but not to limit the actual sizes.

Figure 1A:
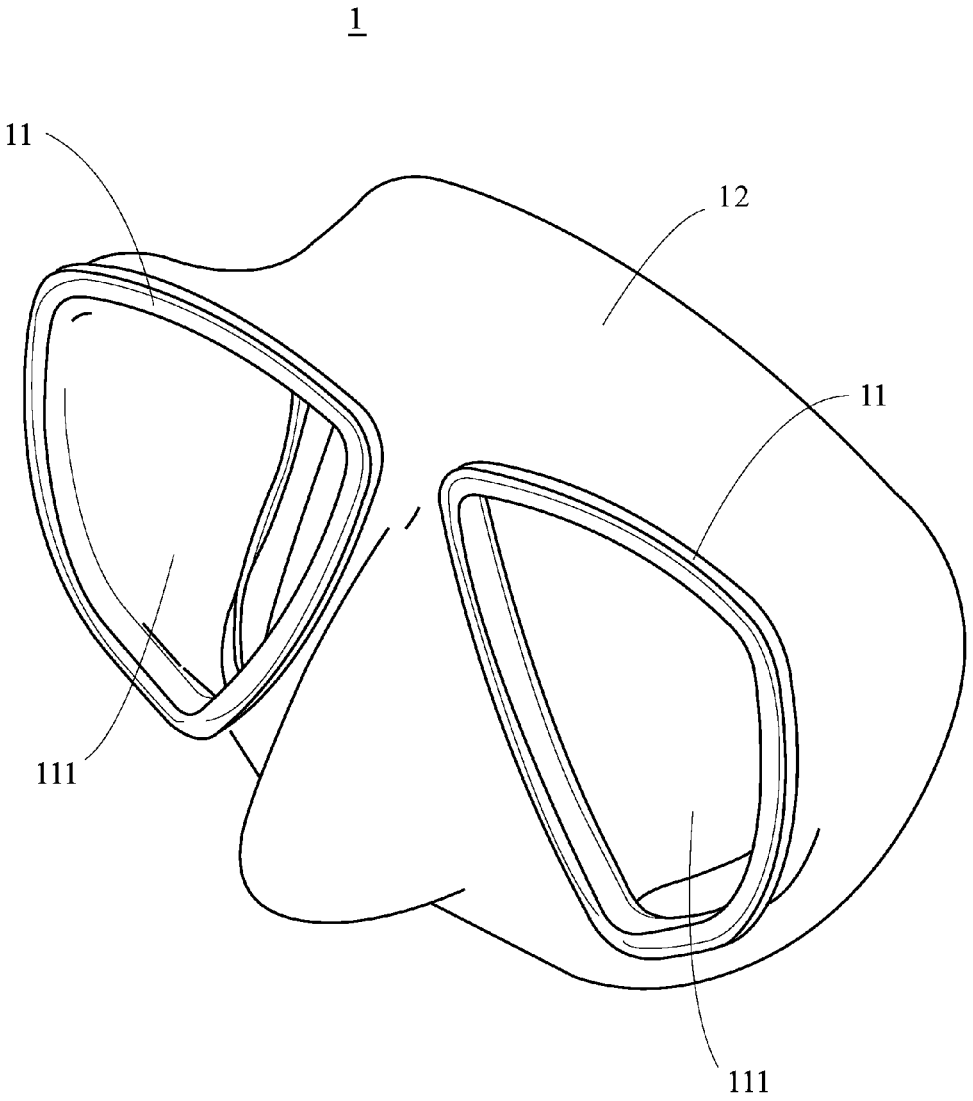
FIG. 1A (Prior art)
FIG. 1A is a schematic view of a conventional waterproof mask.
Figure 1B:
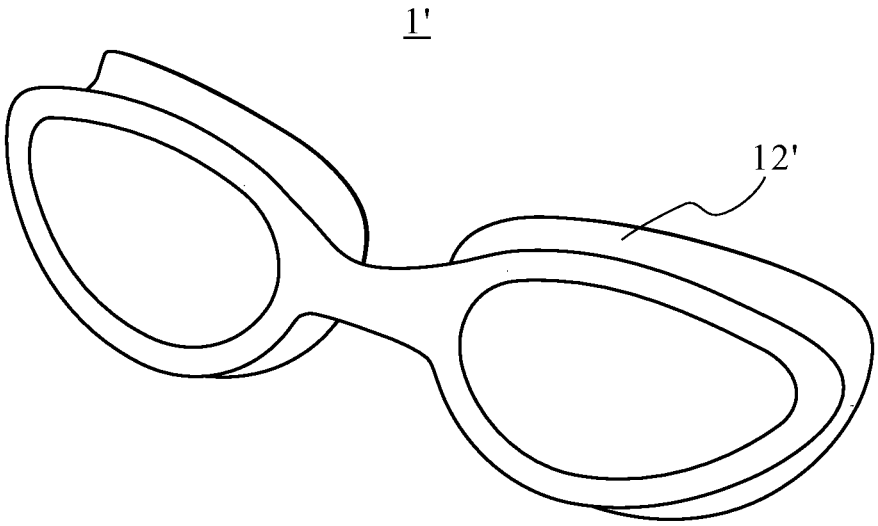
FIG. 1B (Prior art)
FIG. 1B is a schematic view of another conventional waterproof mask.
Figure 2:
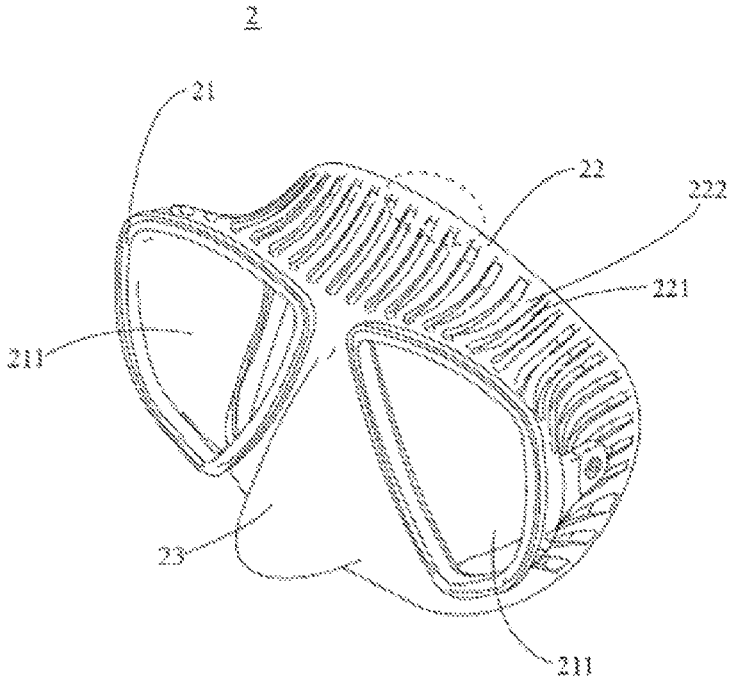
FIG. 2 is a schematic view of a waterproof mask of the first embodiment.

The first embodiment of the present invention is a waterproof mask. FIG. 2 illustrates a schematic perspective view of a waterproof mask 2. The waterproof mask 2 comprises a frame portion 21, a leaning portion 22 and a nose mask portion 23, which define two cavities for covering the user's eyes and nose respectively.

The frame portion 21 has two lenses 211, and is tightly connected to the leaning portion 22. The nose mask portion 23 is disposed below the frame portion 21 and adjacent to a lower portion of the leaning portion 22. The leaning portion 22 has a plurality of first structures 221 and a plurality of second structures 222. The first structures 221 and the second structures 222 are alternately arranged approximately along the same direction and spaced apart from each other. The first thickness of each of the first structures 221 is thinner than the second thickness of each of the second structures 222. More specifically, according to the present invention, the first thickness is between 0.05 mm and 2.5 mm, while the second thickness is between 1 mm and 6 mm. The first thickness is thinner than the second thickness by about 0.05 mm to 5.95 mm.

Figure 3:
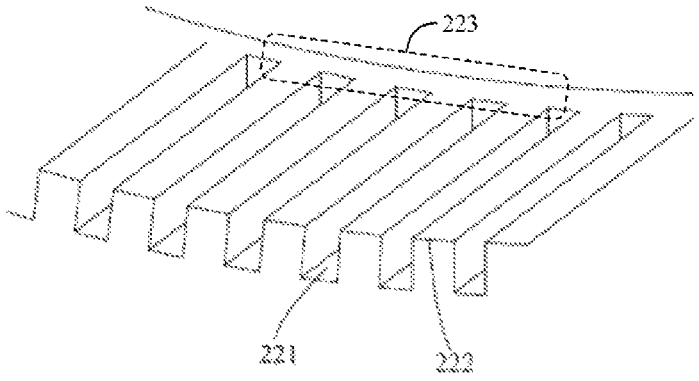
FIG. 3 is a partially enlarged view of the waterproof mask of the first embodiment.

FIG. 3 illustrates a partially enlarged view of some of the first structures 221 and the second structures 222 of the leaning portion 22 of FIG. 2 that are circled by the dashed ellipse. In this embodiment, the first structures 221 and the second structures 222 are of a long strip structure; and both the first structures 221 and the second structures 222 cross the periphery of the leaning portion 22, for example, approximately perpendicular to the periphery of the leaning portion 22 or forming included angles therebetween. That is, as seen by the user, the first structures 221 and the second structures 222 appear as concave and convex stripes that are alternately and longitudinally arranged. In other examples of this embodiment, those skilled in the art may devise a different number of long strips as long as the number of the first structures is no less than two and the number of the second structure is also no less than two. As shown in FIG. 3, the leaning portion 22 further comprises a rim portion 223 extending around a periphery of the leaning portion 22, and the first structures 221 and the second structures 222 are spaced apart from the rim portion 223.

Figure 4:
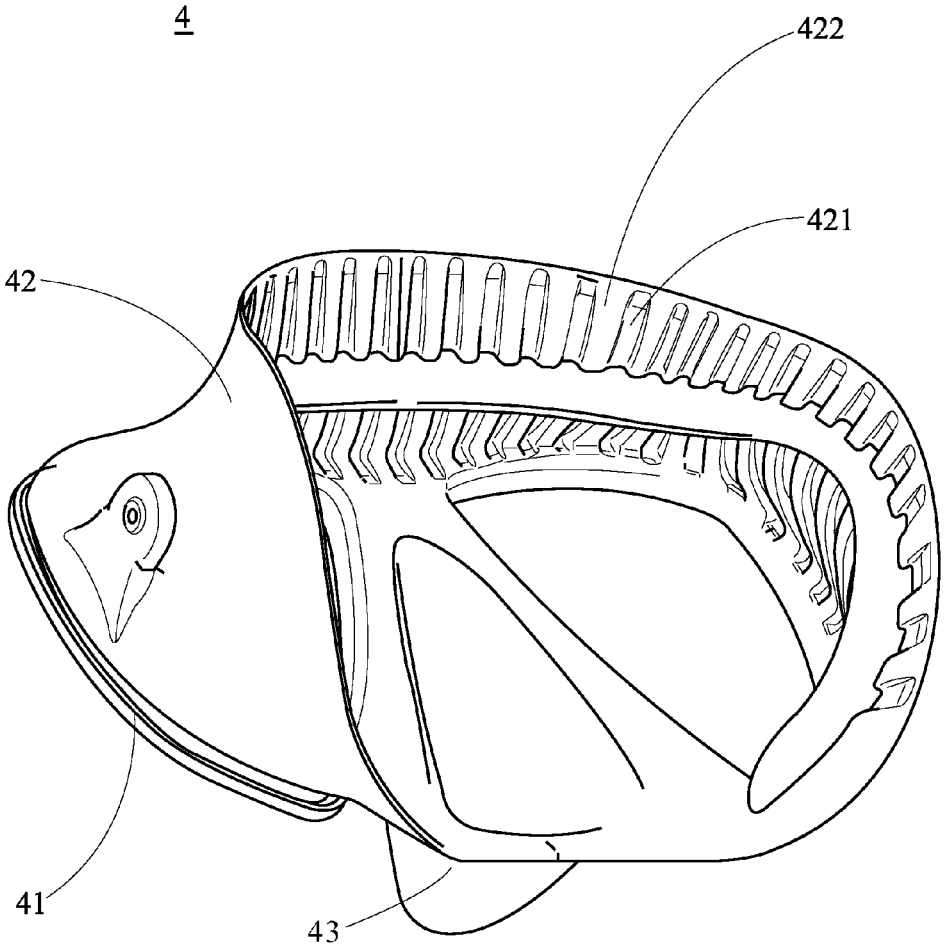
FIG. 4 is a schematic view of another example of the waterproof mask of the first embodiment.

It shall be appreciated that the first structures 221 and the second structures 222 that are shaped as concave and convex long strips in the first embodiment are formed on the upper surface of the leaning portion 22. The lower surface (i.e., the surface that contacts with the user's face) of the leaning portion 22 is a flat lower surface. Similarly, a waterproof mask 4 as shown in FIG. 4 may also be devised by those skilled in the art. In this embodiment, the waterproof mask 4 also comprises a frame portion 41, a leaning portion 42 and a nose mask portion 43. However, the leaning portion 42 has a flat upper surface, while the first structures 421 and the second structures 422 are formed on the lower surface of the leaning portion 42. Therefore, the leaning portion 42 is attached to the user's face directly with the first structures 421 and the second structures 422.

The leaning portion of the waterproof mask of the present invention is made of a flexible material, which has a Shore hardness between A10 and A95. The flexible material can be any of the following: thermoplastic rubber (TPR), thermoplastic polyurethane (TPU), thermoplastic elastomer (TPE), polyvinyl chloride (PVC), silicone rubber, rubber or a combination thereof; however, other materials may also be used by those of ordinary skill in the art as a replacement, and there is no limitation thereon.

Figure 5:
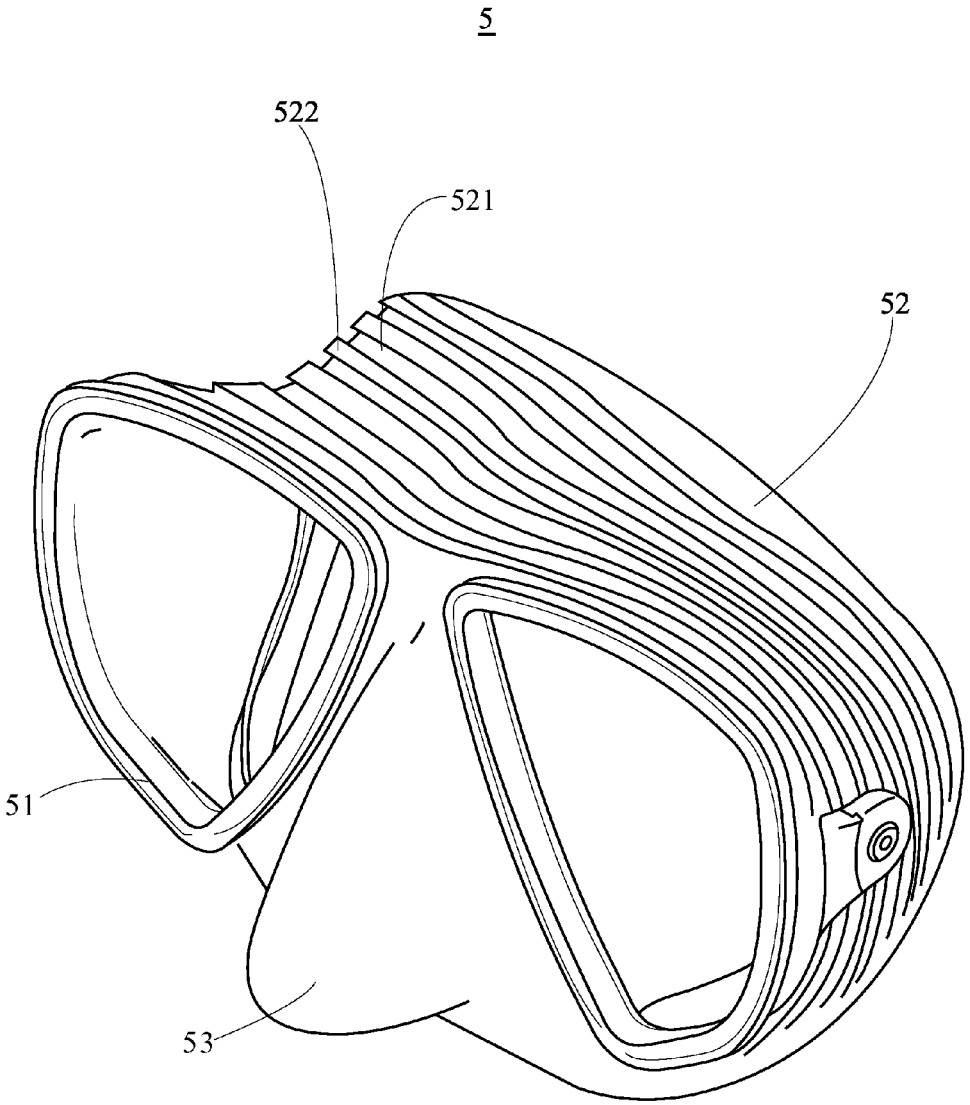
FIG. 5 is a schematic view of a waterproof mask of the second embodiment.

The second embodiment of the present invention is also a waterproof mask. FIG. 5 illustrates a schematic front view of a waterproof mask 5. The waterproof mask 5 of the second embodiment also has a frame portion 51, a leaning portion 52 and a nose mask portion 53, so most of the technical features thereof are identical to those of the first embodiment of the present invention and thus will not be further described herein. However, it shall be particularly appreciated that the second embodiment differs from the first embodiment mainly in that each of the first structures 521 and each of the second structures 522 in the waterproof mask 5 of the second embodiment do not cross the periphery of the leaning portion 52, i.e., are approximately parallel with the periphery of the leaning portion 52. That is, as seen by the user, the first structures 521 and the second structures 522 appear as concave and convex stripes that are arranged alternatively and transversely but not longitudinally.

According to the first embodiment and the second embodiment described above, other similar examples may also be devised by those skilled in the art. When the first structures and the second structures are implemented as concave and convex long strips, they may be arranged alternately and radially, or arranged in other regular forms; or alternatively, they may take the form of a plurality of segments of discontinuous concave and convex long strips or be arranged in other irregular forms.

Figure 6:
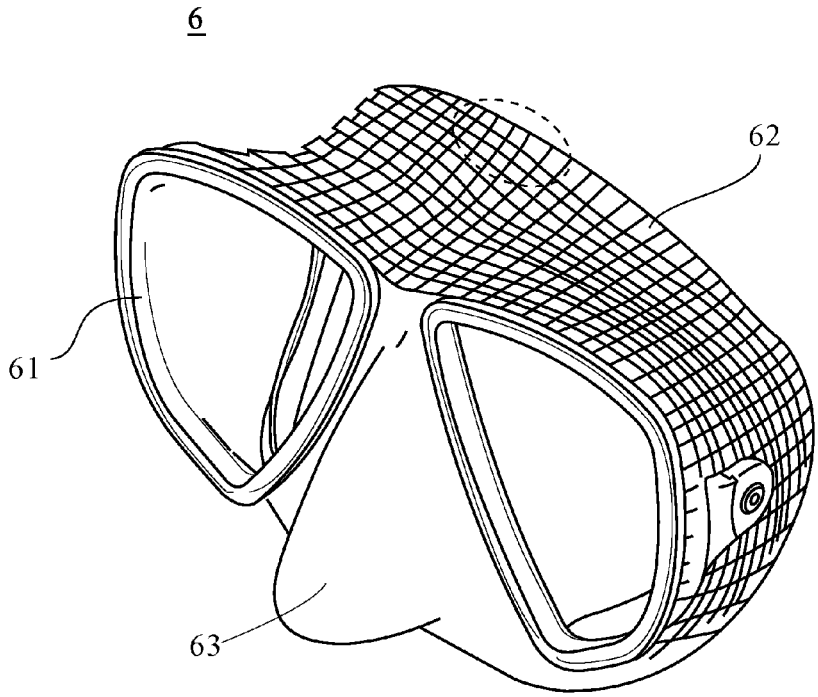
FIG. 6 is a schematic view of a waterproof mask of the third embodiment.
Figure 7:
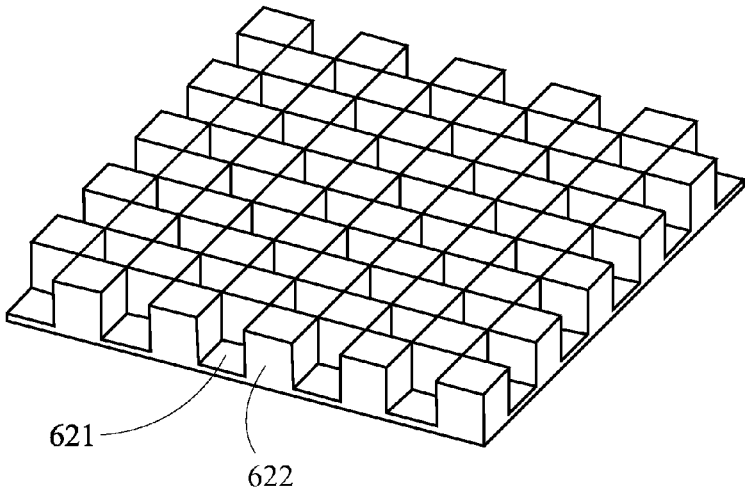
FIG. 7 is a partially enlarged view of the waterproof mask of the third embodiment.

The third embodiment of the present invention is also a waterproof mask. FIG. 6, illustrates a schematic front view of a waterproof mask 6. A partially enlarged view of the detailed structure circled by the dashed ellipse in FIG. 6 is shown in FIG. 7. The waterproof mask 6 of the third embodiment also has a frame portion 61, a leaning portion 62 and a nose mask portion 63, so most of the technical features thereof are identical to those of the aforesaid embodiments and thus will not be further described herein. However, it shall be particularly appreciated that the third embodiment differs from the first embodiment and the second embodiment mainly in that each of first structures 621 and each of second structures 622 in the third embodiment are rectangular blocks. The first structures 621 and the second structures 622 are alternately arranged as an array.

In the third embodiment, the first structures 621 and the second structures 622 are rectangular blocks; however, in other applications, the first structures and the second structures may also be designed as chunks of other shapes such as cylinders, cones, elliptic cylinders, elliptic cones, quadrangular cylinders, quadrangular cones, or the like. The first structures and the second structures are not limited to an array arrangement, but may also be alternately arranged in other forms either irregularly or regularly.

Figure 8:
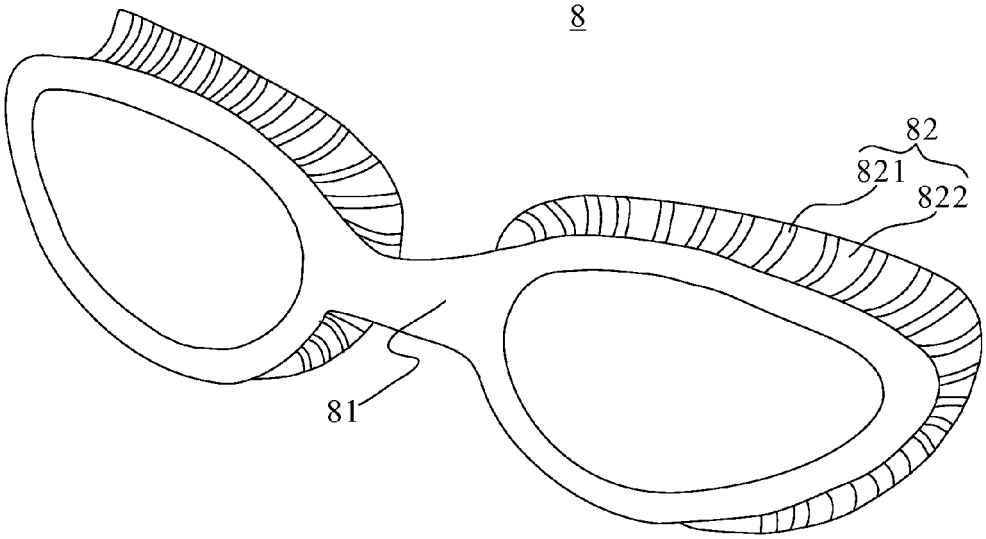
FIG. 8 is a schematic view of a waterproof mask of the fourth embodiment.

The aforesaid embodiments are all waterproof masks for use in diving or snorkeling; however, the waterproof masks are not merely limited to use in diving or snorkeling but may be used in any case where a waterproof mask is needed. Furthermore, the nose mask portion may be eliminated from or added to the waterproof masks depending on whether a waterproof portion around the user's nose is needed. For example, FIG. 8 is a schematic view of a waterproof mask for use in swimming. In this fourth embodiment shown in FIG. 8, the waterproof mask 8 is a pair of swimming goggles, which also has a frame portion 81 and a leaning portion 82. The leaning portion 82 is tightly connected to the frame portion 81, and also has a plurality of first structures 821 and a plurality of second structures 822. The first structures 821 and the second structures 822 are alternately arranged approximately along the same direction, and the first thickness of each of the first structures 821 is thinner than the second thickness of each of the second structures 822.

In this embodiment, the portion of the leaning portion 82 of the waterproof mask that comes into contact with the user's face is also designed as a structure that is shaped like an accordion pleated skirt. Thereby, the leaning portion 82 can deform to conform to the user's face shape for a perfect fit. Similarly, instead of being limited to what has been described above, the first structures 821 and the second structures 822 of the leaning portion 82 in this embodiment may also be replaced by structures of other shapes or arranged in other forms.

Figure 9:
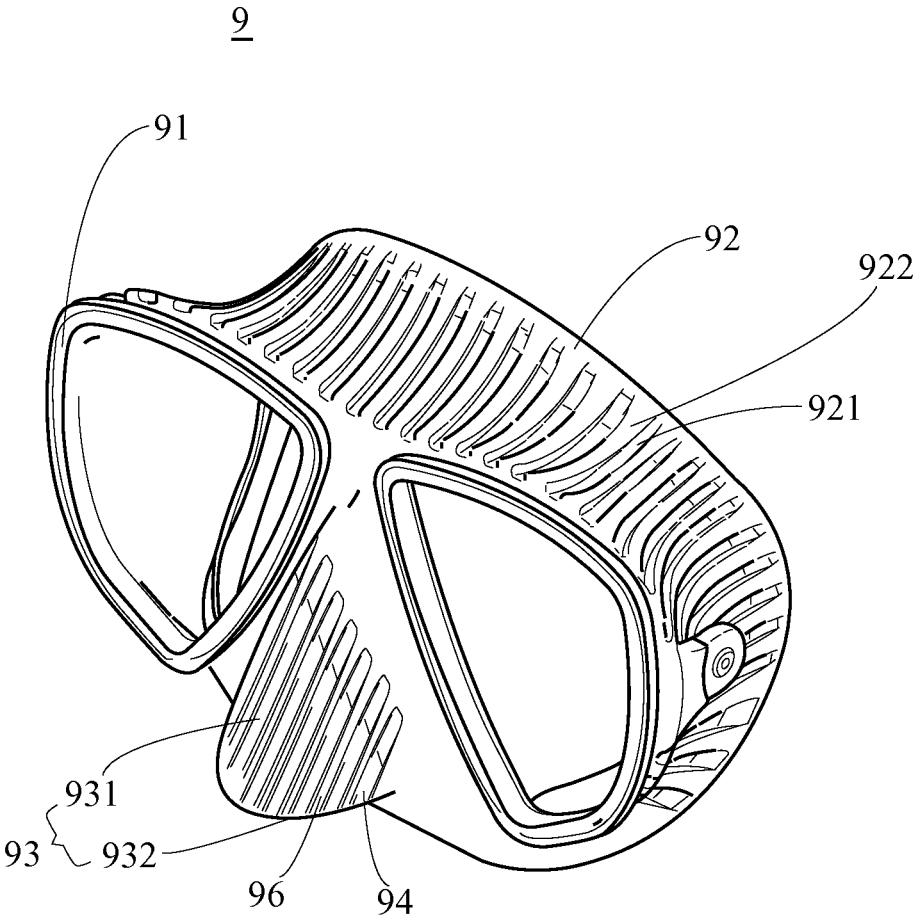
FIG. 9 is a schematic view of a waterproof mask of the fifth embodiment.

The fifth embodiment of the present invention is a waterproof mask. FIG. 9 illustrates the schematic perspective view of a waterproof mask 9. The waterproof mask 9 also comprises a frame portion 91, a leaning portion 92 and a nose mask portion 93, so most of the technical features thereof are identical to those of the first embodiment of the present invention and thus will not be further described herein.

However, in this embodiment, the nose mask portion 93 is also disposed below the frame portion 91 and adjacent to a lower portion of the leaning portion 92. It shall be particularly appreciated that the nose mask portion 93 comprises a bulge 931 and a base 932, and the bulge 931 is connected to the base 932. The bulge 931 has a plurality of third structures 94 and a plurality of fourth structures 96. The third structures 94 and the fourth structures 96 are alternately arranged approximately along the direction and spaced apart from each other. The third thickness of each of the third structures 94 is thinner than the fourth thickness of each of the fourth structures 96. More specifically, according to the present invention, the third thickness is between 0.05 mm and 2.5 mm, while the fourth thickness is between 1 mm and 6 mm. The third thickness is thinner than the fourth thickness by about 0.05 mm to 5.95 mm.

FIG. 3 illustrates a partially enlarged view of the first structures 921, while FIG. 9 illustrates the second structures 922 of the leaning portion 92 and also is a partially enlarged view of the third structures 94 and the fourth structures 96 of the bulge 931 in the nose mask portion 93. In this embodiment, the first structures 921, the second structures 922, the third structures 94 and the fourth structures 96 are of a long strip structure. That is, as seen by the user, the first structures 921, the second structures 922, the third structures 94 and the fourth structures 96 appear as concave and convex stripes that are alternately and longitudinally arranged. In other examples of this embodiment, those skilled in the art may devise a different number of long strips as long as the number of the first structures and the third structures are no less than two and the number of the second structures and the fourth structures are also no less than two.

Figure 10:
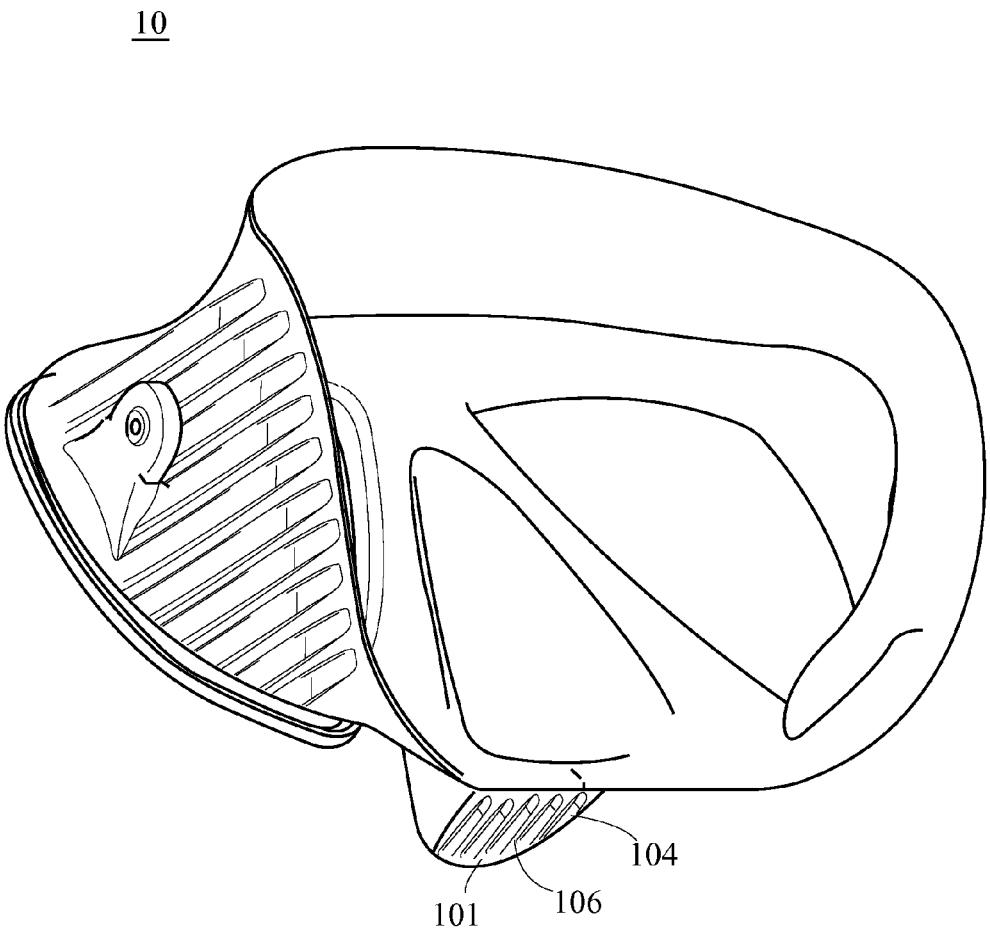
FIG. 10 is a schematic view of a waterproof mask of the sixth embodiment.

According to the aforesaid embodiments, a waterproof mask 10 may also be devised as FIG. 10. In the sixth embodiment, the elements of the waterproof mask 10 are identical to those of the fifth embodiment and thus will not be further described herein. The difference between the fifth embodiment and the sixth embodiment is the third structures 104 and the fourth structures 106 are alternately arranged in the base 101 and not in the bulge 931 of the fifth embodiment.

In reference to FIG. 6 and FIG. 7, the third structures and the fourth structures said in the fifth embodiment and the sixth embodiment may be further devised as the structures and arrangements of the first structures and the second structures of the third embodiment shown in FIG. 6 and FIG. 7, i.e., each of the third structures and the fourth structures are rectangular blocks and are alternately arranged as an array. However, it shall be particularly appreciated that the thickness difference and the appearance of the first and second structures may be different or similar to that of the third and fourth structures.

In other applications, the third structures and the fourth structures also may be designed as chunks of other shapes such as cylinders, cones, elliptic cylinders, elliptic cones, quadrangular cylinders, quadrangular cones, or the like. The third and fourth structures are not limited to an array arrangement, but may also be alternately arranged in other forms either irregularly or regularly.

Because the fifth and sixth embodiments have the third and fourth structures formed with different thicknesses, the users can easily pinch the bulge along the bridge of the nose to remove the liquid from the bulge. In order to pinch and deform the bulge, the nose mask portion of the waterproof mask of the fifth, sixth and other relative embodiments is made of a flexible material, which has a Shore hardness between A10 and A95. The flexible material can be any of the following: thermoplastic rubber (TPR), thermoplastic polyurethane (TPU), thermoplastic elastomer (TPE), polyvinyl chloride (PVC), silicone rubber, rubber or a combination thereof; however, other materials may also be used by those of ordinary skill in the art as a replacement, and there is no limitation thereon.

According to the aforesaid embodiments, other examples may be devised by those skilled in the art. For example, the leaning portion does not necessarily need to be fully covered by the first and second structures as long as there is a difference in thickness with the third and fourth structures of the nose mask portion. In the present invention, the first and second structures of the leaning portion and the third and fourth structures of the nose mask portion also have different thicknesses. By virtue of the flexibility provided by the thinner first and third structures and the secure support from the thicker second and fourth structures, the user, when wearing the waterproof mask, does not need to worry about the waterproof mask being too soft and causing discomfort when the mask presses against the cheeks. Moreover, the waterproof mask can also be stretched to fit the different face shapes so that users of various face shapes can wear it comfortably. As a result, the cost is reduced for the manufactures because they no longer need to manufacture waterproof masks of different sizes to cater for various demands.

The above disclosure is related to the detailed technical contents and inventive features thereof. People skilled in this field may proceed with a variety of modifications and replacements based on the disclosures and suggestions of the invention as described without departing from the characteristics thereof. Nevertheless, although such modifications and replacements are not fully disclosed in the above descriptions, they have substantially been covered in the following claims as appended.

What is claimed is:

1. A waterproof mask, comprising:

a frame portion;

a leaning portion, being tightly connected to the frame portion, the leaning portion having an upper surface and a lower surface opposing to the upper surface, in which the lower surface is flat for contacting a user's face; and a nose mask portion, disposed below the frame portion and adjacent to a lower portion of the leaning portion, wherein the nose mask portion comprises a bulge and a base connected to the bulge;

wherein the upper surface of the leaning portion has a plurality of first structures and a plurality of second structures being alternately arranged with the first structures, in which each of the first structures has a first thickness smaller than a second thickness of each of the second structures, wherein the first structures and the second structures are long stripes which are arranged transversely along a periphery of the upper surface;

wherein the bulge has a plurality of third structures and a plurality of fourth structures, the third structures and the fourth structures are alternately arranged, and a third thickness of each of the third structures is thinner than a fourth thickness of each of the fourth structures.

2. The waterproof mask as claimed in claim 1, wherein the frame portion contains at least one lens.

3. The waterproof mask as claimed in claim 1, wherein the first structures have at least two first structures, and the second structures have at least two second structures.

4. The waterproof mask as claimed in claim 1, wherein a Shore hardness of a material of the leaning portion is between A10 to A95.

5. The waterproof mask as claimed in claim 4, wherein the material is a flexible material including Thermoplastic Rubber (TPR), Thermoplastic Polyurethane (TPU), Thermoplastic Elastomer (TPE), Polyvinyl Chloride (PVC), silicone rubber, rubber and the combination thereof.

6. The waterproof mask as claimed in claim 1, wherein the nose mask portion is defined with a cavity.

7. The waterproof mask as claimed in claim 1, wherein the base has a plurality of fifth structures and a plurality of sixth structures, the fifth structures and the sixth structures are alternately arranged, and a fifth thickness of each of the fifth structures is thinner than a sixth thickness of each of the sixth structures.

8. The waterproof mask as claimed in claim 7, wherein each of the fifth structures and each of the sixth structures are long stripes, alternately arranged along a direction.

9. The waterproof mask as claimed in claim 7, wherein each of the fifth structures and each of the sixth structures are chunks.

10. The waterproof mask as claimed in claim 9, wherein the fifth structures and the sixth structures are alternately and irregularly arranged.

11. The waterproof mask as claimed in claim 7, wherein the fifth thickness is between 0.05 mm and 2.5 mm and the sixth thickness is between 1 mm and 6 mm, and the fifth thickness is 0.05 mm to 5.95 mm thinner than the sixth thickness.

12. The waterproof mask as claimed in claim 1, wherein each of the third structures and each of the fourth structures are long stripes, alternately arranged along a direction.

13. The waterproof mask as claimed in claim 1, wherein each of the third structures and each of the fourth structures are chunks.

14. The waterproof mask as claimed in claim 13, wherein the third structures and the fourth structures are alternately and irregularly arranged.

15. The waterproof mask as claimed in claim 1, wherein the third thickness is between 0.05 mm and 2.5 mm and the fourth thickness is between 1 mm and 6 mm, and the third thickness is 0.05 mm to 5.95 mm thinner than the fourth thickness.

16. The waterproof mask as claimed in claim 1, wherein a Shore hardness of a material of the nose mask portion is between A10 to A95.

17. The waterproof mask as claimed in claim 16, wherein the material is a flexible material including Thermoplastic Rubber (TPR), Thermoplastic Polyurethane (TPU), Thermoplastic Elastomer (TPE), Polyvinyl Chloride (PVC), silicone rubber, rubber and the combination thereof.

18. A waterproof mask, comprising:

a frame portion;

a leaning portion, being tightly connected to an upper end of the frame portion, the leaning portion having an upper surface and a lower surface opposing to the upper surface, in which the lower surface is provided to contact a user's face; and a nose mask portion, disposed below the frame portion and adjacent to a lower portion of the leaning portion, wherein the nose mask portion comprises a bulge and a base connected to the bulge;

wherein the leaning portion has a plurality of first structures and a plurality of second structures being alternately arranged with the first structures, in which each of the first structures has a first thickness thinner than a second thickness of each of the second structures;

wherein the first structures and the second structures are long stripes which are arranged transversely along a periphery of the upper surface;

wherein the bulge has a plurality of the third structures and a plurality of fourth structures, the third structures and the fourth structures are alternately arranged, and a third thickness of each of the third structures is thinner than a fourth thickness of each of the fourth structures.

* * * * *